US010280662B2

(12) United States Patent
Jeong

(10) Patent No.: US 10,280,662 B2
(45) Date of Patent: May 7, 2019

(54) SAFETY DOOR LOCK USING DOOR HANDLE

(71) Applicant: Tae Young Jeong, Guri-si (KR)

(72) Inventor: Tae Young Jeong, Guri-si (KR)

( * ) Notice: Subject to any disclaimer, the term of this patent is extended or adjusted under 35 U.S.C. 154(b) by 452 days.

(21) Appl. No.: 14/913,926

(22) PCT Filed: Jul. 20, 2015

(86) PCT No.: PCT/KR2015/007492
§ 371 (c)(1),
(2) Date: Feb. 23, 2016

(87) PCT Pub. No.: WO2016/108374
PCT Pub. Date: Jul. 7, 2016

(65) Prior Publication Data

US 2016/0340944 A1 Nov. 24, 2016

(30) Foreign Application Priority Data

Dec. 31, 2014 (KR) ..... 10-2014-0195050

(51) Int. Cl.
*E05B 17/00* (2006.01)
*E05C 17/00* (2006.01)
(Continued)

(52) U.S. Cl.
CPC ..... *E05C 17/00* (2013.01); *E05B 1/00* (2013.01); *E05B 1/003* (2013.01); *E05B 1/0061* (2013.01);
(Continued)

(58) Field of Classification Search
CPC ..... Y10S 292/15; Y10S 292/27; E05B 1/00; E05B 1/003; E05B 1/0038; E05B 1/0061;
(Continued)

(56) References Cited

U.S. PATENT DOCUMENTS 318,323 A * 5/1885 Teetzel ..... E05C 17/443 292/207
509,489 A * 11/1893 Reynolds ..... E05B 13/04 292/150
(Continued)

FOREIGN PATENT DOCUMENTS

CN 203066617 U 7/2013
CN 203961443 U 11/2014
(Continued)

OTHER PUBLICATIONS

European Search Report dated Apr. 6, 2017 issued in Application No. 15834783.1.
(Continued)

*Primary Examiner* — Carlos Lugo
(74) *Attorney, Agent, or Firm* — KED & Associates, LLP

(57) ABSTRACT

A safety door lock may include the door handle configured to be rotatable about a rotational axis and to slidably reciprocate in a horizontal direction and having a sliding groove on the side surface thereof adjacent to a door. The safety door lock may include a body combined with an inside of the sliding groove to form a rotating shaft with another door handle provided at the other side of the door and supporting sliding of the door handle so as to protrude the door handle from the front end of the door. The safety door lock may include an elastic unit fixed to the body, and elastically relaxing the door handle and the body. Other embodiments may also be provided.

13 Claims, 18 Drawing Sheets

(51) Int. Cl.

| | |
|---|---|
| ***E05F 5/06*** | (2006.01) |
| ***E05B 1/00*** | (2006.01) |
| ***E05C 21/00*** | (2006.01) |
| ***E05C 17/50*** | (2006.01) |
| ***E05F 5/04*** | (2006.01) |
| *E05B 81/00* | (2014.01) |

(52) U.S. Cl.
CPC ..... *E05B 17/005* (2013.01); *E05C 17/50* (2013.01); *E05C 21/00* (2013.01); *E05F 5/04* (2013.01); *E05F 5/06* (2013.01); *E05B 2001/0076* (2013.01); *E05F 2005/046* (2013.01); *E05Y 2201/68* (2013.01); *E05Y 2900/10* (2013.01); *E05Y 2900/132* (2013.01); *Y10S 292/15* (2013.01)

(58) Field of Classification Search
CPC ..... E05B 1/0084; E05B 17/005; E05C 17/00; E05C 17/50; Y10T 16/61; Y10T 16/458
USPC ..... 292/336.3, 347, 348, 352, 354; 49/383, 49/460
See application file for complete search history.

(56) References Cited

U.S. PATENT DOCUMENTS

| | | | | | |
|---|---|---|---|---|---|
| 1,191,855 | A * | 7/1916 | Tuszka | G05G 1/085 | 16/110.1 |
| 1,612,446 | A * | 12/1926 | Larson | B66F 13/00 | 16/429 |
| 2,029,711 | A * | 2/1936 | Frantz | E05F 5/06 | 16/82 |
| 2,107,699 | A * | 2/1938 | Groeschel | E05F 5/04 | 16/86 A |
| 2,488,635 | A * | 11/1949 | Martin | E05B 65/0014 | 292/347 |
| 4,194,265 | A * | 3/1980 | Zimmermann | E05C 17/28 | 16/82 |
| 4,437,621 | A * | 3/1984 | Sakumoto | G05G 1/085 | 242/284 |
| 4,482,179 | A * | 11/1984 | Johnson | E05B 1/0038 | 292/336.3 |
| 5,288,116 | A * | 2/1994 | Donofrio | E05B 1/0053 | 16/DIG. 30 |
| 5,375,295 | A * | 12/1994 | Woodward | E05B 1/0053 | 16/412 |
| 5,443,570 | A * | 8/1995 | Hirano | A01K 89/009 | 242/284 |
| 5,713,614 | A * | 2/1998 | Anderson | E05B 1/0053 | 16/413 |
| 6,164,156 | A * | 12/2000 | Purcell | G05G 1/04 | 49/344 |
| 6,352,289 | B1 | 3/2002 | Fan | | |
| 6,669,241 | B1 * | 12/2003 | Kelley | E05B 1/0053 | 16/413 |
| 7,258,374 | B2 * | 8/2007 | Rusiana | E05C 1/14 | 292/244 |
| 7,661,734 | B2 * | 2/2010 | Lignell | E05B 13/001 | 292/288 |
| 7,690,701 | B2 * | 4/2010 | Van Ravenhorst | E05C 3/044 | 292/194 |
| 7,866,714 | B2 * | 1/2011 | Monig | E05B 81/76 | 292/336.3 |
| 7,905,525 | B2 * | 3/2011 | Badia | E05B 17/007 | 16/82 |
| 8,522,482 | B2 * | 9/2013 | Buck | E05B 1/0069 | 16/320 |
| 9,828,793 | B2 * | 11/2017 | Shah | E05C 1/14 | |

FOREIGN PATENT DOCUMENTS

| | | | | |
|---|---|---|---|---|
| DE | 29708110 | U1 * | 7/1997 | E05B 1/00 |
| DE | 20 2008 016 806 | U1 | 3/2009 | |
| DE | 202016105578 | U1 * | 1/2018 | E05B 1/003 |
| EP | 1076140 | A1 * | 2/2001 | E05B 13/00 |
| FR | 2082711 | A5 * | 12/1971 | E05C 17/00 |
| JP | 59-171177 | U | 11/1984 | |
| JP | 2003-232164 | | 8/2003 | |
| JP | 2009-024366 | A | 2/2009 | |
| KR | 20-0377568 | Y1 | 3/2005 | |
| KR | 10-0786322 | B1 | 12/2007 | |
| KR | 10-2011-0002582 | A | 1/2011 | |
| KR | 10-2012-0007680 | A | 1/2012 | |
| KR | 20-2014-0005384 | U | 10/2014 | |
| WO | WO-2012131219 | A1 * | 10/2012 | E05B 1/003 |

OTHER PUBLICATIONS

International Search Report and Written Opinion dated Oct. 30, 2015 issued in Application No. PCT/KR2015/007492.
European Search Report dated Sep. 7, 2017 issued in Application No. 15834783.1.
Rubber as used in ETSI Protection—"Safer Door-Handle with Modern Look"; Feb. 11, 2013; Archived webpage http://www.productdesignplus.com/2013/02/safer-door-handle-modem.html.
Korean Office Action dated Mar. 5, 2015 issued in Application No. 10-2014-0195050.

* cited by examiner (a)

(b)

SAFETY DOOR LOCK USING DOOR HANDLE

TECHNICAL FIELD

The present invention relates to a safety door lock using a door handle, and, more particularly, to a safety door lock using a door handle in which a space set between a door and a doorframe is formed to prevent safety accidents.

BACKGROUND ART

In general, a door provides a function of forming an independent space by dividing the space from another space using steel or wood.

A steel door is disposed at an outdoor space and has functions as a gate and crime prevention, like a front door, and a wooden door is disposed between a space and another space so as to divide an indoor space.

Here, the wooden door has a function of selectively shielding a space formed by a doorframe, including a doorpost and a door threshold combined with each other, between walls of an indoor space and, for example, a sliding door, a hinged door, etc. are representatively used as wooden doors.

Among these wooden doors, in case of a hinged door mainly used indoors, at the moment when the hinged door is opened and closed, safety accidents are frequently generated between the door and a doorpost.

Therefore, in order to protect infants or children from safety accidents, an elastic material, such as a sponge, is inserted into the front end of a door, or a door holder to prevent closing of a door is mounted on the door.

However, such an elastic material is inserted into the front end of the door, only as needed, and then is released from the door, thus causing cumbersomeness. Further, if an infant bites or touches the elastic material, the elastic material may be released from the door. Moreover, the door holder causes a door to be open at all times.

If the elastic material is released from the door or an infant manipulates the door holder mounted at the lower part of the door, the infant may get hurt physically or mentally.

DISCLOSURE

Technical Problem

An object of the present invention is to provide a safety door lock using a door handle which allows the door handle provided on a door to shift to a door opening and closing mode or a door closing prevention mode so as to prevent the door from being suddenly closed during opening of the door.

Technical Solution

To achieve these objects and other advantages and in accordance with the purpose of the invention, as embodied and broadly described herein, a safety door lock using a door handle includes the door handle configured to be rotatable in the vertical direction and to slidably reciprocate in the horizontal direction and having a sliding groove on the side surface thereof adjacent to a door, a body combined with the inside of the sliding groove to form a rotating shaft with another door handle provided at the other side of the door and supporting sliding of the door handle so as to protrude the door handle from the front end of the door, and an elastic unit fixed to the body, relatively sliding within the sliding groove and elastically relaxing the door handle and the body.

The elastic unit may include a fixing member fixed to the body, an elastic member bent integrally from one end of the fixing member, a support member extending integrally from the elastic member and disposed in parallel with the fixing member so as to have elasticity relative to the fixing member, and a fixing unit provided on the fixing member or the elastic member to fix the door handle sliding on the elastic unit to a designated position.

The fixing unit may include an elastic spring provided within a guide hole formed within the elastic unit and a pair of bearings disposed at both ends of the elastic spring and configured to interfere with the door handle.

The door handle may include position fixing grooves formed within the sliding groove so as to correspond to the position of the fixing unit, the pair of bearings being elastically inserted into the position fixing grooves.

The safety door lock may further include a protective member provided on at least one of the door handle and a doorpost or a strike plate adjacent to the edge of the front end of the door to prevent abrasion or noise generated by contact.

In another embodiment of the present invention, a safety door lock using a door handle includes the door handle configured to be rotatable in the vertical direction and to elastically reciprocate in the horizontal direction and provided adjacent to the front end of the door at one side of a door, rotated by a designated angle in the vertical direction and then pushed to be opened or pulled to be closed, a body configured to form a rotating shaft with another door handle provided at the other side of the door or to support the door handle so as to be rotatable by a designated angle in connection with a door latch, an elastic unit interposed between the body and the door handle and providing restoring force to elastically reciprocate the door handle on the body in the direction of the rotating shaft, and a shock absorption unit provided at a bent part of the door handle so as to elastically rotate the door handle in the horizontal direction.

The body may include an interference member detachably coupled with the door handle and selectively interworking with rotation of the door handle and a mount member configured to fix the interference member to the door so as to be rotatable.

A coupling groove may be formed within one of the interference member and the door handle, the other one of the interference member and the door handle may correspond to the shape of the coupling groove and be detachably inserted into the coupling groove, and the coupling groove may have an oval or polygonal cross-section.

The safety door lock may further include a protective member provided on at least one of the door handle and the doorpost or the strike plate adjacent to the edge of the front end of the door to prevent abrasion or noise generated by contact.

The door handle may include a first handle part grasped by a user and a second handle part elastically connected to one side of the first handle part in the vertical direction, and the shock absorption unit may be provided at a connection region between the first handle part and the second handle part and elastically coupling the first handle part with the second handle part.

The shock absorption unit may include a coupling hole formed at one side of the first handle part, a connection shaft coupled with the inside of the coupling hole and serving to couple the first handle part with the second handle part so as to be rotatable with respect to the second handle part, and a torsion spring coupled with the connection shaft and providing elastic force to the first handle part and the second handle part.

The shock absorption unit may further include a noise proof member provided at a part of the inner surface of the coupling hole contacting the second handle part during rotation of the first handle part and a shock absorption member provided at a part of the second handle part contacting the first handle part in a right angle state between the first handle part and the second handle part.

In yet another embodiment of the present invention, a safety door lock using a door handle includes the door handle configured to be rotatable in the vertical direction and provided adjacent to the front end of the door at one side of a door, rotated by a designated angle in the vertical direction and then pushed to be opened or pulled to be closed, a body configured to form a rotating shaft with another door handle provided at the other side of the door or to support the door handle so as to be rotatable by a designated angle in connection with a door latch, an extension part combined with the body to separate the door handle from the door by a designated interval, and a handle setting unit configured to selectively rotate the door handle hinged to the extension part into one of a door opening and closing mode and a door closing prevention mode.

The handle setting unit may include a rotating shaft to couple second coupling pieces provided at one end of the door handle with a first coupling piece protruding from the end of the extension part so as to be rotatable, elastic assemblies provided in the inner spaces of the second coupling pieces and providing elastic force to interfere with rotation of the door handle on the first coupling piece about the rotating shaft, and an extension piece extending to protrude one end of the second coupling pieces from an extension line of the radius of rotation formed around the rotary shaft.

Fixing grooves concaved from the inner surface of one side of the first coupling piece may be formed at positions contacting the second coupling pieces and a fixing protrusion protruding at a position corresponding to the positions of the fixing grooves and inserted into the fixing grooves to prevent separation of the second coupling pieces from the first coupling piece may be formed on the second coupling pieces.

Each the elastic assemblies may include a spring provided within the inner space and a bush member interposed between the spring and the rotating shaft to press the rotating shaft using elastic force of the spring.

Advantageous Effects

A safety door lock using a door handle in accordance with the present invention has effects, as below.

First, a door opening and closing mode and a door closing prevention mode may be simply adjusted.

Second, safety accidents generated by sudden closing of a door may be prevented in the door closing prevention mode.

Third, the safety door lock may be easily compatible with doors generally used on the market.

BEST MODE

Figure 1:
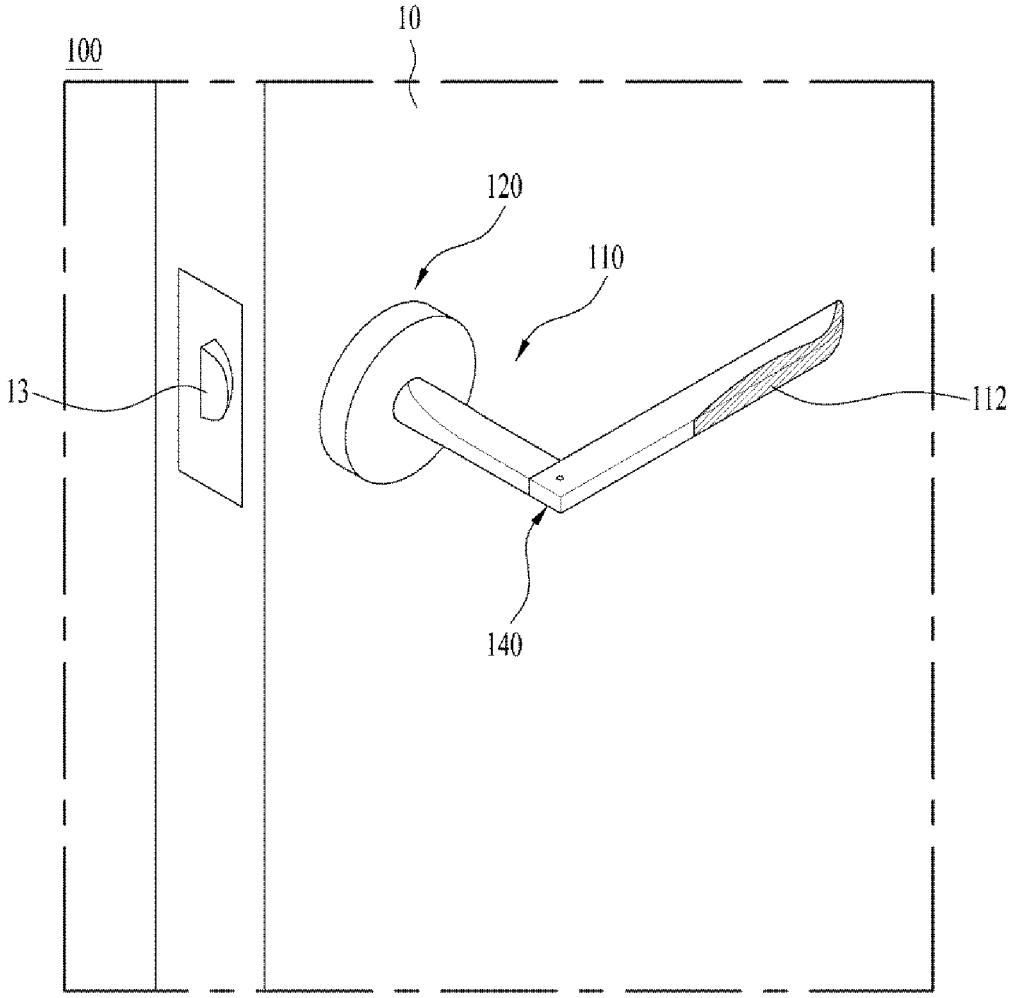
FIG. 1 is a perspective view illustrating a safety door lock using a door handle in accordance with one embodiment of the present invention.

Reference will now be made in detail to the preferred embodiments of the present invention, examples of which are illustrated in the accompanying drawings. In the drawings, the same or similar elements are denoted by the same reference numerals even though they are depicted in different drawings. In the following description of the present invention, a detailed description of known functions and configurations incorporated herein will be omitted when it may make the subject matter of the present invention rather unclear. Also, some features illustrated in the drawings are exaggerated, reduced or simplified and the drawings and elements in the drawings are not always illustrated in a proper scale. However, these details will be easily understood by those skilled in the art.

A safety door lock 100 or 200 using a door handle in accordance with the present invention is provided on a hinged door 10 provided on a doorpost 11 and provides a function of achieving any one of a door opening and closing mode in which the safety door lock 100 or 200 serves as a general door handle and a door closing prevention mode (a safety mode) in which at least a part of the door maintains an opened state. Hereinafter, safety door locks 100 and 200 using a door handle in accordance with embodiments of the present invention will be described in detail.

Figure 2:
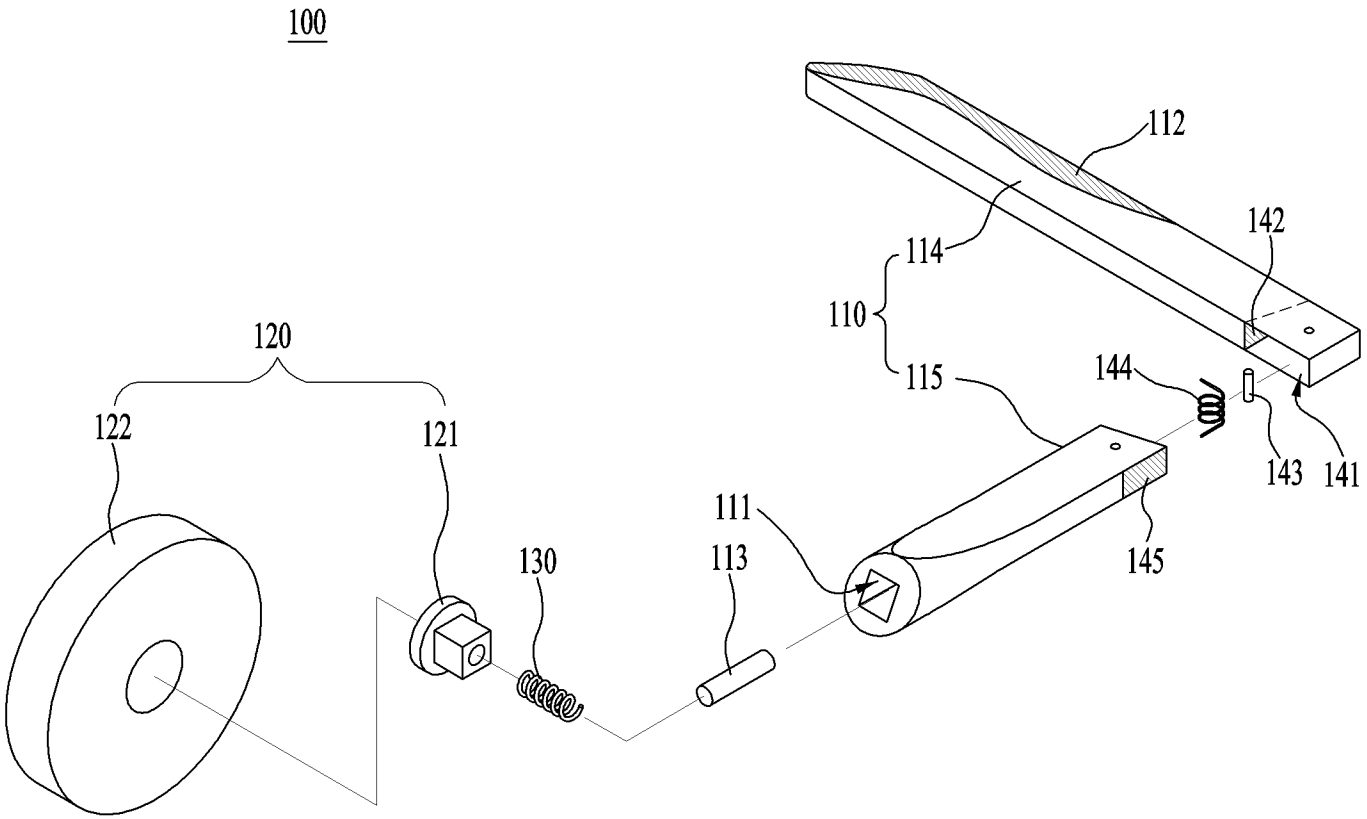
FIG. 2 is an exploded perspective view of the safety door lock shown in FIG. 1.

FIG. 1 is a perspective view illustrating a safety door lock 100 using a door handle in accordance with one embodiment of the present invention and FIG. 2 is an exploded perspective view of the safety door lock 100 shown in FIG. 1.

With reference to FIGS. 1 and 2, the safety door lock 100 in accordance with one embodiment of the present invention includes a door handle 110 grasped and rotated by a user, a body 120 to combine the door handle 110 with a door 10, and an elastic unit 130 interposed between the body 120 and the door handle 110 to elastically combine the door handle 110 with the body.

Here, the door handle 110 may include an inside handle located inside the door 10 and an outside handle located outside the door 10 and, for example, as the door handle 110, a handle which is disposed at a designated position so as to be grasped by a user, rotated by pressure, and then pushed to be opened or pulled to be closed may be used.

Although, in general, an outside handle is disposed at such a position in an indoor space, such as a residential space, an inside handle may be disposed at such a position. Further, according to indoor structures or purposes, such a handle structure may be applied to another door handle disposed in the opposite direction to the position of the door handle so as to be grasped by a user, rotated and then pushed to be opened or pulled to be closed.

The door handle 110 is disposed close to the front end of the edge of the opened and closed door 10 and coupled with a rotating shaft formed at the center of rotation of the body 120.

A coupling groove 111 is formed within one of coupling parts of the door handle 110 and the body 120 and the other of the coupling parts is coupled with the coupling groove 110 so that the door handle 110 and the body 120 are rotated in connection with each other.

This embodiment exemplarily describes a structure in which the coupling groove 111 is formed within the door handle 110 and a part of the body 120 is inserted into the coupling groove 111 so as to be rotated. Of course, a coupling groove may be formed within the body 120 and the door handle 110 may have a structure coupled with the groove formed within the body 120.

A separate connection shaft 113 to connect the door handle 110 and the body 120 to each other or to connect the door handle 110, the body 120 and another door handle 110 provided on the other side of the door 10 may be provided within the door handle 110.

Further, the body 120 includes an interference member 121 coupled with the door handle 110 and a mount member 122 to fix the interference member 120 to the door 10 so as to be rotatable.

Therefore, the door handle 110 is elastically coupled with the interference member 121 and is configured such that, if a user grasps the door handle 110 and applies pressure to the door handle 110 in the horizontal direction, the door handle 110 is separated from the interference member 121.

Here, the interference member 121 has a shape which is coupled with the coupling groove 111 and interferes with the coupling groove 111 in the rotating direction.

The interference member 121 may have a shape corresponding to the shape of the coupling groove 111 and such a shape may have an oval or polygonal cross-section. Of course, as exemplarily shown in FIG. 2, the shape of the interference member 121 may have a regular polygonal cross-section including a square cross-section.

The door handle 110 includes a first handle part 114 grasped by a user and rotated in the vertical direction and a second handle part 115 elastically connected to one side of the first handle part 114 in the vertical direction. A shock absorption unit 140 to elastically couple the first handle 114 with the second handle 115 is provided at the connection region between the first handle part 114 and the second handle part 115.

The shock absorption unit 140 includes a coupling hole 141 formed at one side of the first handle part 114, a connection shaft 143 coupled with the inside of the coupling hole 141 and serving to couple the first handle part 114 with the second handle part 115 so as to be rotatable with respect to the second handle part 115, and a torsion spring 144 coupled with the connection shaft 143 and providing elastic force to the first handle part 114 and the second handle part 115.

Further, the shock absorption unit 140 includes a noise proof member 142 provided at a part of the inner surface of the coupling hole 141 which contacts the second handle part 115 during rotation of the first handle part 114, and a shock absorption member 145 provided at a part of the second handle part 115 which contacts the first handle part 114 in a state in which the first handle part 114 and the second handle part 115 form a right angle.

Therefore, the first handle part 114 is configured so as to be elastically rotated within a designated range if external force is applied to the first handle part 114 on the second handle part 115 in the direction of the door 10 and, at this time, the first handle part 114 is rotated and prevents external force from being directly transmitted to the door 10. Further, noise or vibration generated by relative rotation of the first handle part 114 and the second handle part 115 may be suppressed, thus increasing durability.

Figure 3:
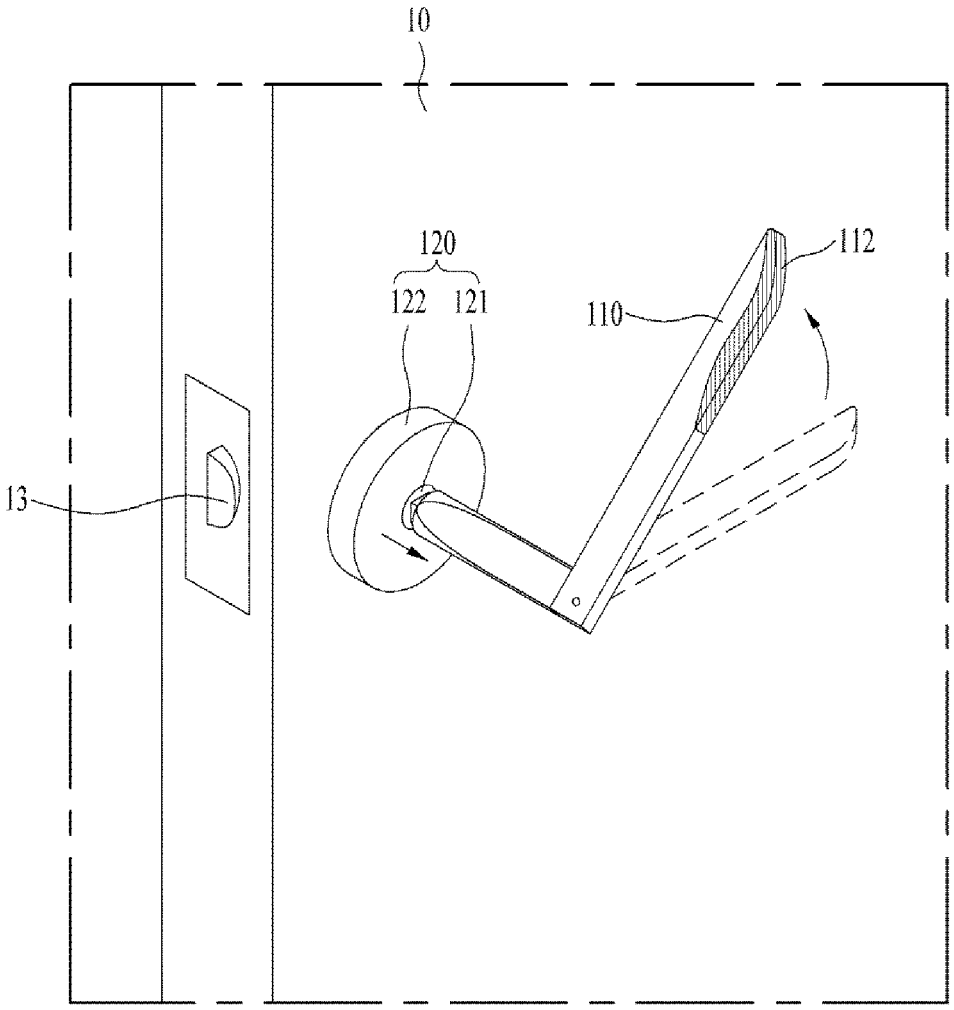
FIG. 3 is a perspective view illustrating the safety door lock shown in FIG. 1 in a rotated state.
Figure 4:
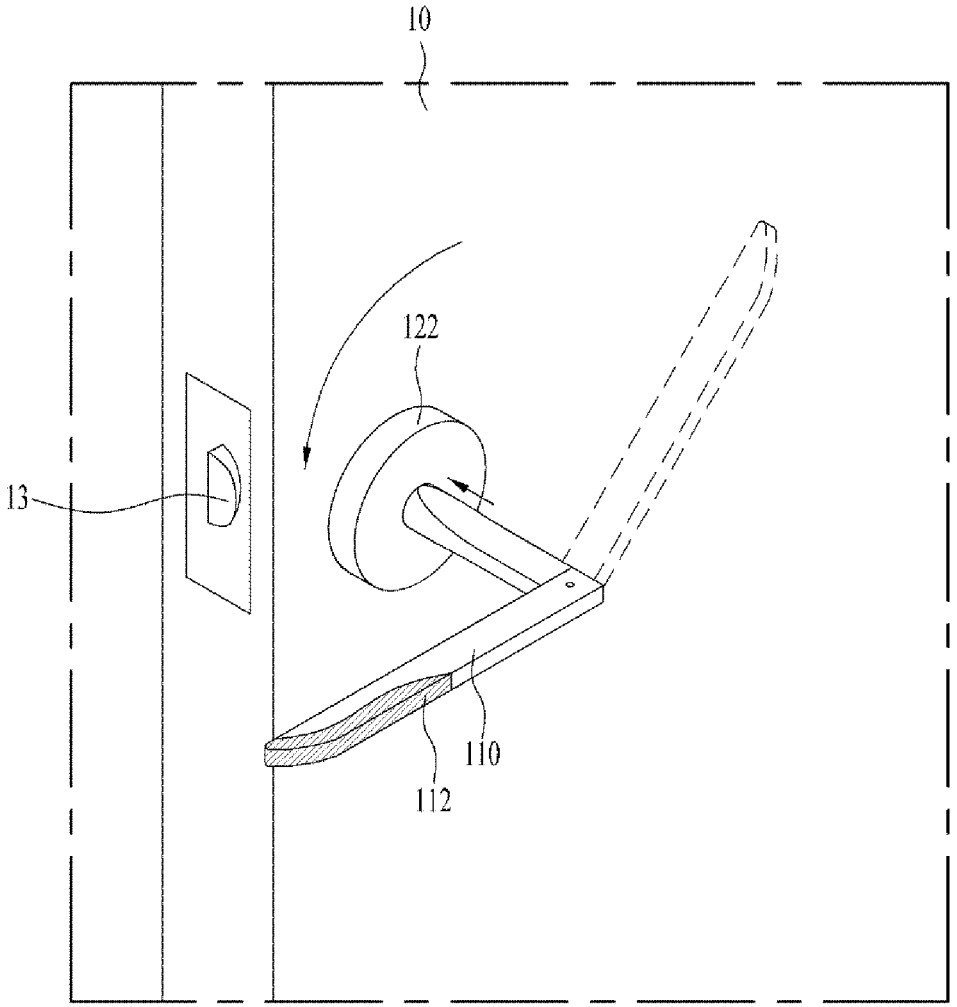
FIG. 4 is a perspective view illustrating the safety door lock shown in FIG. 1, which is rotated into a door closing prevention mode.
Figure 5:
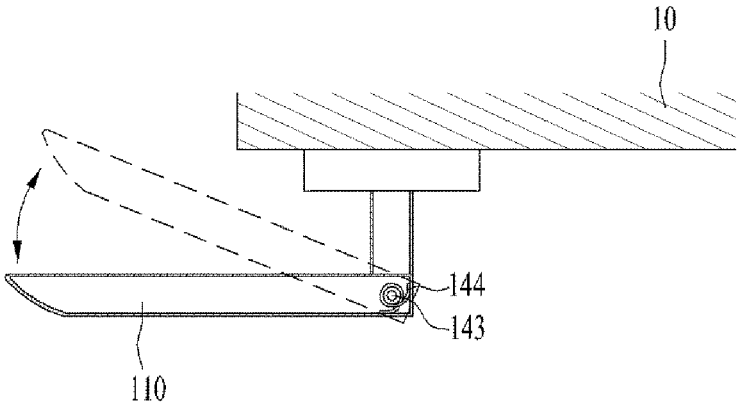
FIGS. 5 to 7 are reference views illustrating the safety door lock shown in FIG. 1, which is rotated into the door closing prevention mode so as not to be closed.
Figure 6:
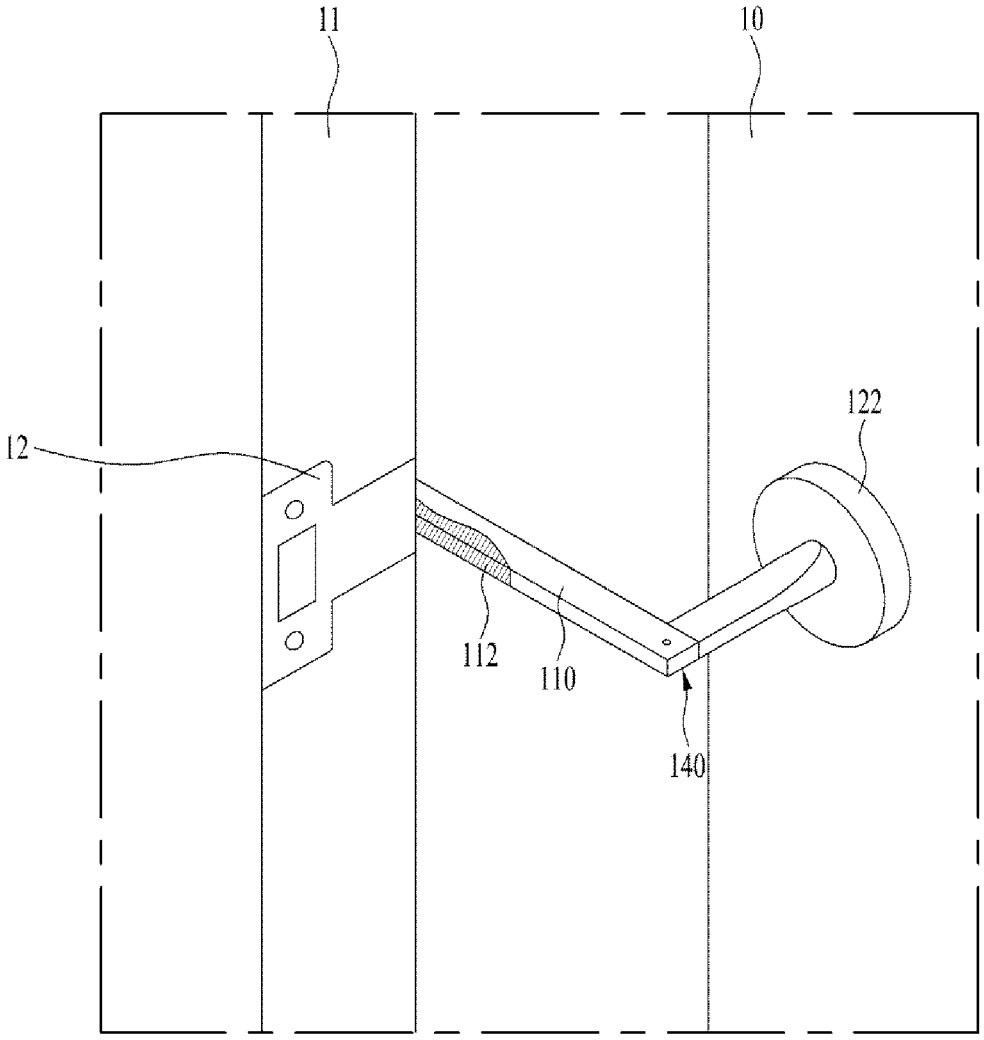
Figure 7:
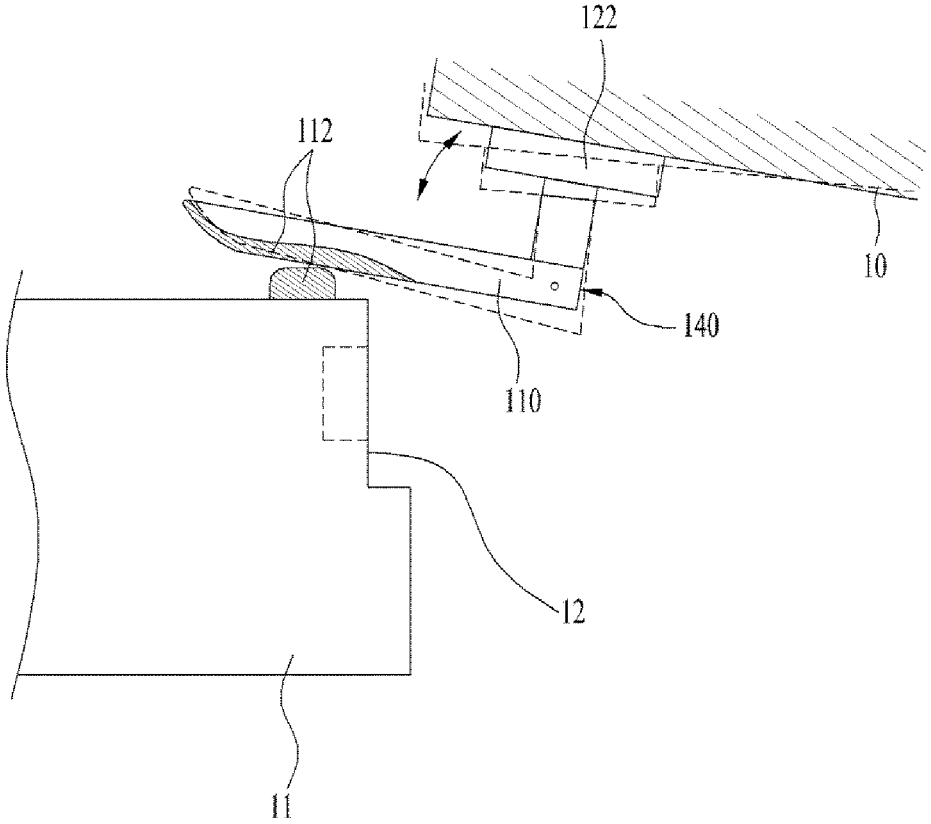

FIG. 3 is a perspective view illustrating the safety door lock 100 shown in FIG. 1 in a rotated state, FIG. 4 is a perspective view illustrating the safety door lock 100 shown in FIG. 1, which is rotated into a door closing prevention mode, and FIGS. 5 to 7 are reference views illustrating the safety door lock 100 shown in FIG. 1, which is rotated into the door closing prevention mode so as not to be closed.

With reference to FIGS. 3 to 7, when a user pulls the door handle 110 in the horizontal direction to separate the door handle 110 from the body 120, as exemplarily shown in FIG. 3, the door handle 110 assumes a state in which the door handle 110 is rotatable in the vertical direction on the body 120 and, then, the user may rotate the door handle 110 in the vertical direction so as to protrude outwards from the front end of the edge of the door 10, as exemplarily shown in FIG. 4.

When the door handle 110 is rotated so as to protrude outwards from the front end of the edge of the door 10, the door handle 110 interferes with closing of the door 10 on the doorpost 11, with which the door 10 is coupled.

Therefore, the door closing prevention mode, in which the door handle 110 contacts one side surface of the doorpost 11 or a strike plate 12 combined with the doorpost 11 and thus complete closing of the door 10 is prevented, is executed. Of course, in the door opening and closing mode, the door handle 110 is located at an original position thereof as in a general door 10 and thus a user may open and close the door while grasping the door handle 110.

Therefore, when the door handle 110 is rotated into the door closing prevention mode, the door 10 may be prevented from being rapidly closed toward the doorpost 11 by external force or gravity and thus safety accidents caused by the door may be prevented.

A separate protective member 112 is provided on the outer surface of the door handle 110 or the doorpost 11 so as to reduce abrasion or noise when the door handle 110 contacts the doorpost 11 or the strike plate 12. Such a protective member 112 may be provided on both the door handle 110 and the doorpost 11 so as to reduce the quantity of impact and to prevent noise.

The protective member 112 may include one selected from the group consisting of a urethane-based resin, a silicone-based resin and an emulsion-based resin and, even when a user shifts the door opening and closing mode to the door closing prevention mode, non-slip effects may be expected. Further, the protective member 112 may be provided so as to be detachably attached to the door handle 110 or to be replaceable. The protective member 112 may be provided as a point type only at a contact region between the door handle 110 and the doorpost 11 or the strike plate 12, or be provided as a pad type on the doorpost 11 in the length direction so as to prevent children from bruises or scratches as well as to prevent friction or noise.

Figure 8:
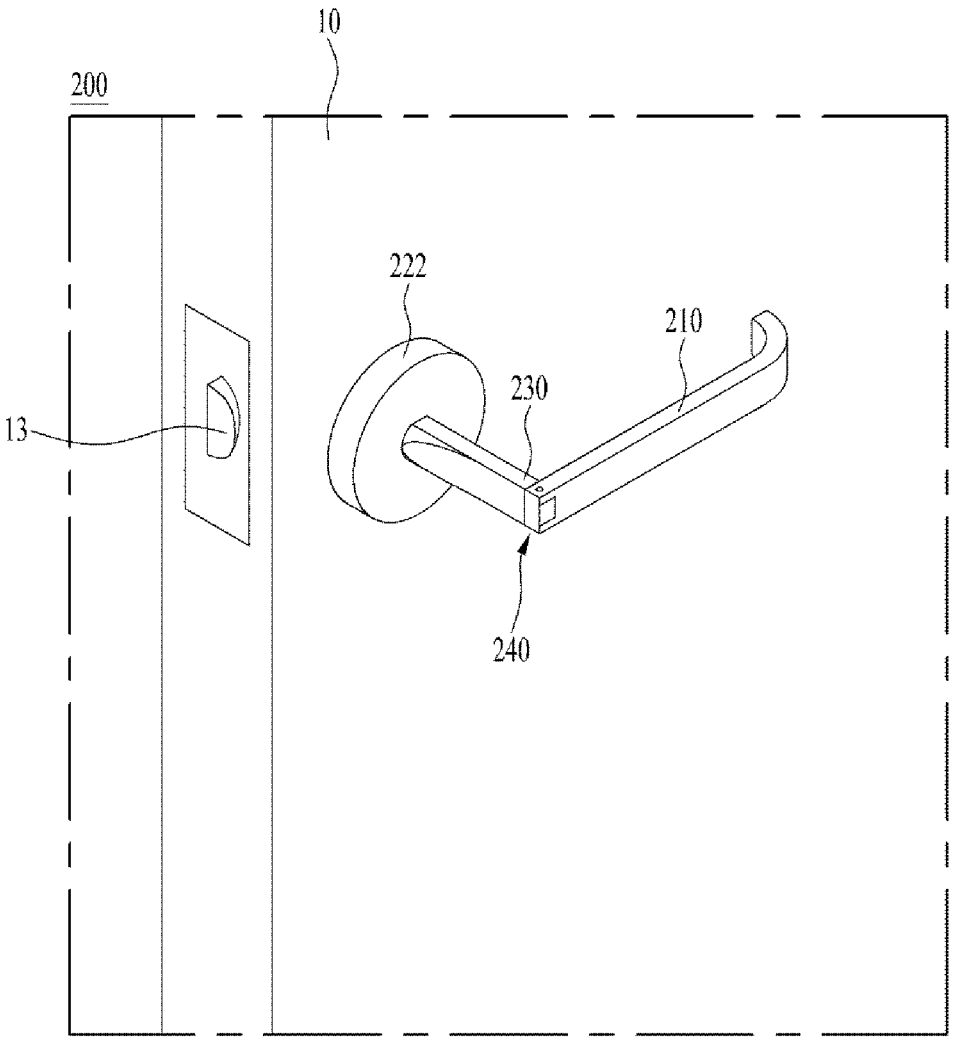
FIG. 8 is a perspective view illustrating a safety door lock using a door handle in accordance with another embodiment of the present invention.
Figure 9:
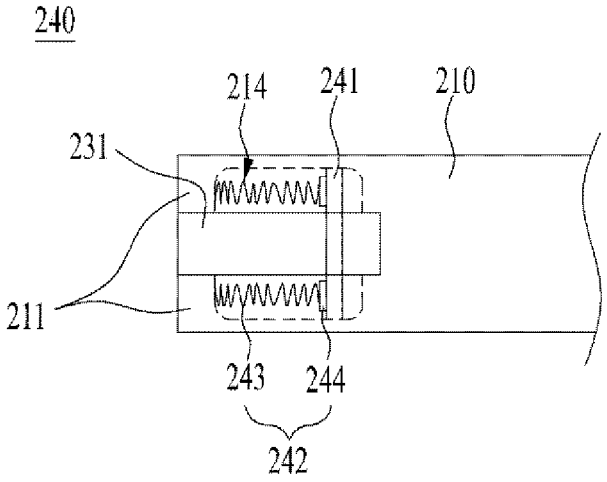
FIG. 9 shows cross-sectional views illustrating operation of the safety door lock shown in FIG. 8.
Figure 9:
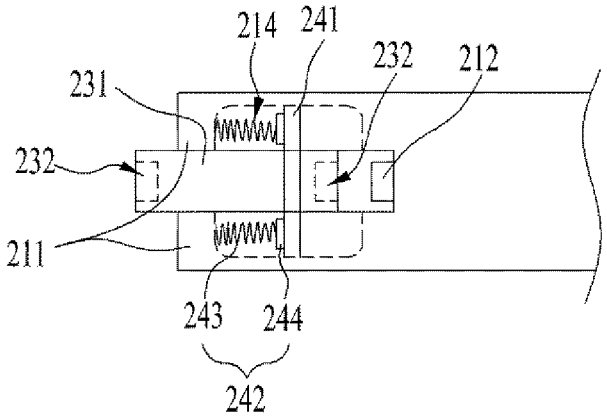

FIG. 8 is a perspective view illustrating a safety door lock 200 using a door handle in accordance with another embodiment of the present invention and FIG. 9 shows cross-sectional views illustrating operation of the safety door lock shown 200 in FIG. 8.

With reference to FIGS. 8 and 9, the safety door lock 200 in accordance with another embodiment of the present invention includes a door handle 210 provided at one side of a door so as to be grasped by a user, a body 220 to form a rotating shaft with another door handle provided at the other side of the door 10 or to support the door handle 120 so as to be rotatable by a designated angle in connection with a door latch 13, an extension part 230 combined with the body 220 to separate the door handle 210 from the door 10 by a designated interval, and a handle setting unit 240 to selectively rotate the door handle 210 hinged to the extension part 230 into one of the door opening and closing mode and the door closing prevention mode.

A first coupling piece 231 protrudes from one end of the extension part 230 and second coupling pieces 211 hinged to the first coupling piece 231 are provided on end of the door handle 210.

The handle setting unit 240 includes a rotating shaft 241 to couple the first coupling piece 231 and the second coupling pieces 211 with each other so as to be rotatable, elastic assemblies 242 provided in the inner spaces 214 of the second coupling pieces 211, and an extension piece 245 protruding from the second coupling pieces 211 and interfering with rotation of the rotating shaft 241.

As exemplarily shown in FIG. 9(*a*), the second coupling pieces 211 in a pair protruding in parallel are provided on the upper and lower parts of the first coupling piece 231. Of course, first coupling pieces 231 in a pair may be provided and a second coupling piece 211 may be located between the first coupling pieces 231.

First, the rotating shaft 241 is fixed to the center of the first coupling piece 231 and is disposed so as to be slidable in the horizontal direction within the inner spaces 214 of the second coupling pieces 211.

Here, the elastic assembly 242 provided within each inner space 214 includes a spring 243 and a bush member 244. Since the bush member 244 of the elastic assembly 242 contacting the rotating shaft 241 is pressed by the spring 243, the second coupling pieces 211 receive elastic force in the leftward direction from the rotating shaft 241 shown in FIG. 9(*a*).

Therefore, the second coupling pieces 211 may not be rotated on the first coupling piece 231 about the rotating shaft 241 in FIG. 9(*a*) and such a state represents the door opening and closing mode. In this state, when a user grasps the door handle 210 and then pushes or pulls in the forward and backward directions, the door may be opened and closed.

As exemplarily shown in FIG. 9(*b*), when a user pulls the door handle 210 in the rightward direction, the second coupling pieces 211 slide on the first coupling piece 231 and move in the rightward direction and, then, the springs 243 are compressed harder and the rotating shaft 241 relatively moves in the leftward direction in the inner spaces 214.

Then, since the extension piece is disposed inside an extension line of the radius of rotation formed around the rotary shaft 241, the second coupling pieces 211 may be rotated about the rotating shaft 241.

Figure 13:
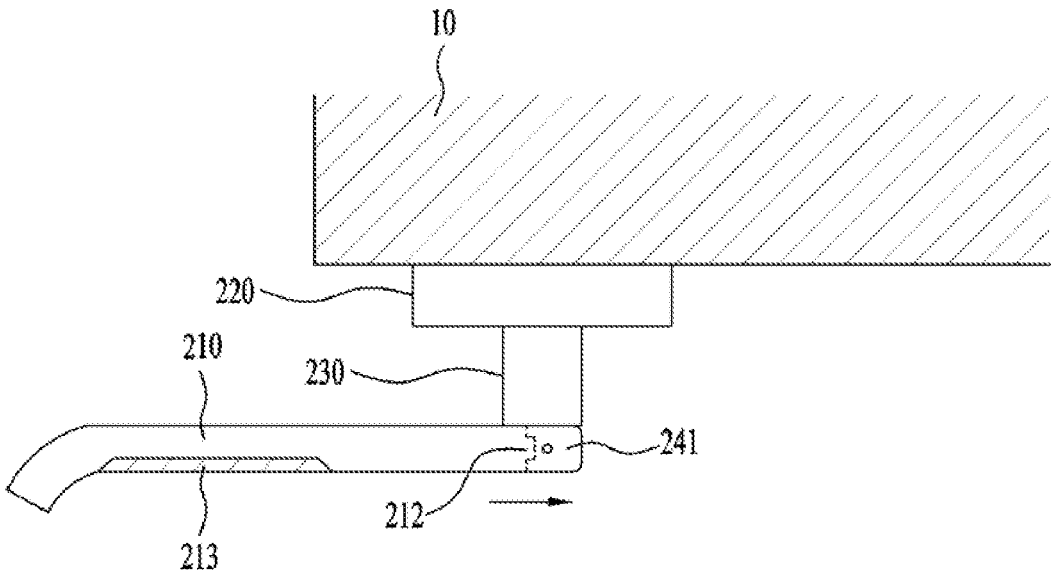

Therefore, in FIG. 9(*b*), the second coupling pieces 211 on the first coupling piece 231 may be rotated into a shape shown in FIG. 13 and, thus, the door closing prevention mode is executed. When a user grasps and pulls the door handle 210, the door handle 210 is rotated in the horizontal direction about the rotating shaft 241 and the safety door lock 200 is shifted to the door closing prevention mode.

Further, the safety door lock 200 may include a fixing protrusion 212 protruding from the inner surfaces of the second coupling pieces 211 and inserted into fixing grooves 232 formed on the inner surface of the first coupling piece 231 to prevent the second coupling pieces 211 on the first coupling piece 231 from being released from the door opening and closing mode.

The fixing protrusion 212 may be inserted into the fixing groove 232, as the second coupling pieces 211 slide on the first coupling piece 231, and the fixing protrusion 212 together with the extension piece 245 provides a function of preventing the second coupling pieces 211 from being rotated in the horizontal direction on the first coupling piece 231 in the door opening and closing mode.

FIGS. 10 to 13 are reference views illustrating operation of the safety door lock 200 shown in FIG. 8.

Figure 10:
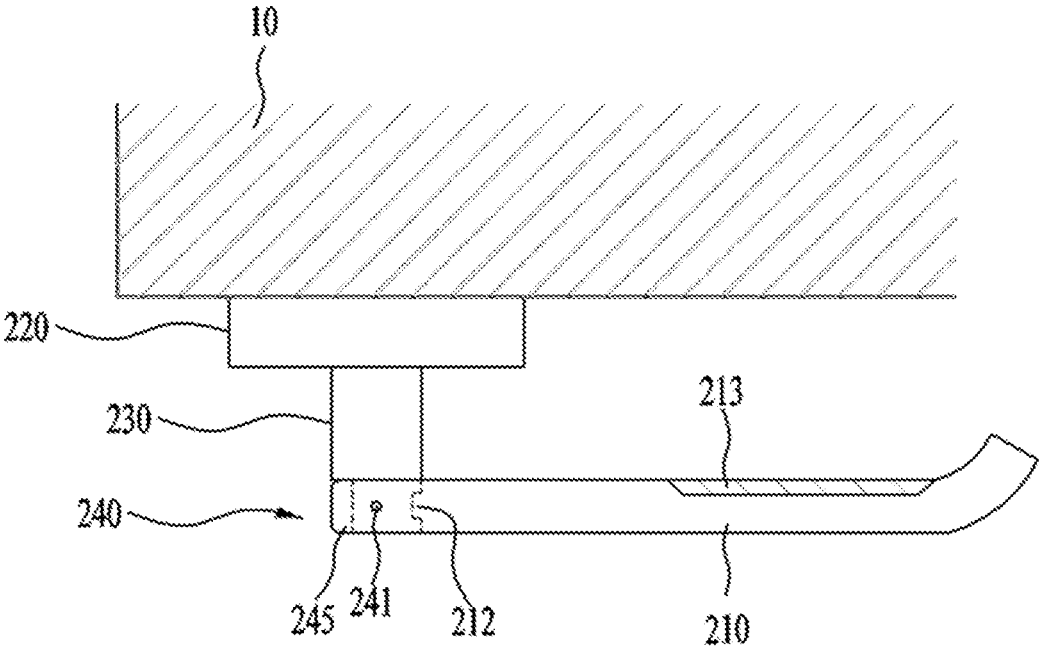
FIGS. 10 to 13 are reference views illustrating operation of the safety door lock shown in FIG. 8.

First, FIG. 10 illustrates the door opening and closing mode. In such a door opening and closing mode, the door handle 210 functions to open and close the door 10, in the same manner as a general door.

Figure 11:
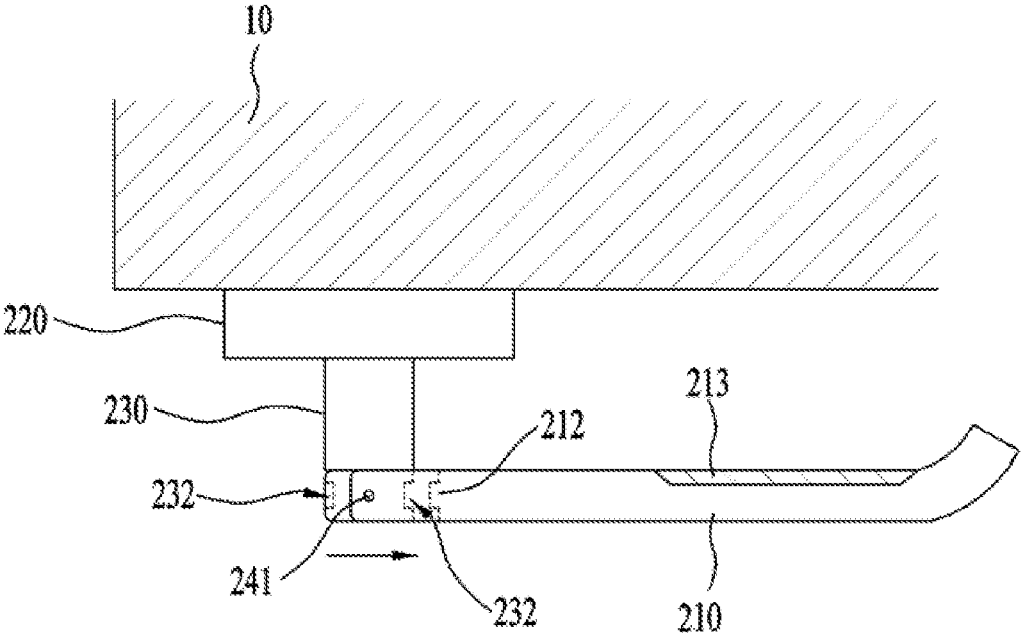

FIG. 11 illustrates a state in which a user pulls the door handle 210 of FIG. 10 in the horizontal direction. Here, the door handle 210 assumes a rotatable state about the rotating shaft 241, the elastic assemblies 242 are in a compressed state and the fixing protrusion 212 is separated from the fixing groove 232.

Figure 12:
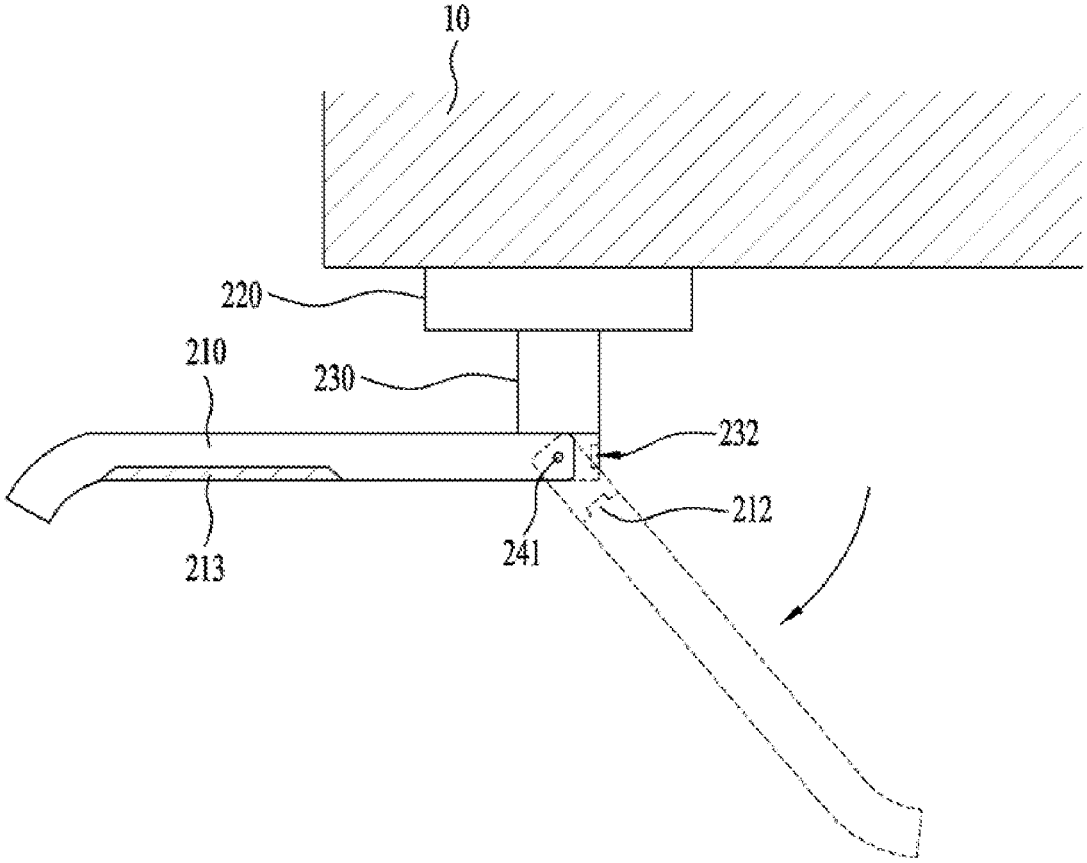

FIG. 12 illustrates a state in which a user rotates the door handle 210 of FIG. 11 in the horizontal direction about the rotating shaft 241.

Therefore, when the door handle 210 protrudes outwards from the front end of the edge of the door 10, as exemplarily shown in FIG. 13, the safety door lock 200 is shifted to the door closing prevention mode.

In this case, in the same manner as the above-described former embodiment, the door 10 may maintain the separated state from the doorpost 11 by a designated interval and a description of effects acquired thereby will be omitted because it is considered to be unnecessary. Further, the door handle 210 includes a protective member to prevent abrasion or noise when the edge of the front end of the door 10 contacts the doorpost or the strike plate 12.

Therefore, the safety door lock 100 or 200 in accordance with the present invention may allow a user to conveniently adjust the door opening and closing mode and the door closing prevention mode, prevent safety accidents generated when the door is suddenly closed in the door closing prevention mode so as to ensure the safety of infants, the elderly and the disabled, prevent noise generated due to sudden closing of the door, and exhibit ease in compatibility with a generally used door.

Figure 14:
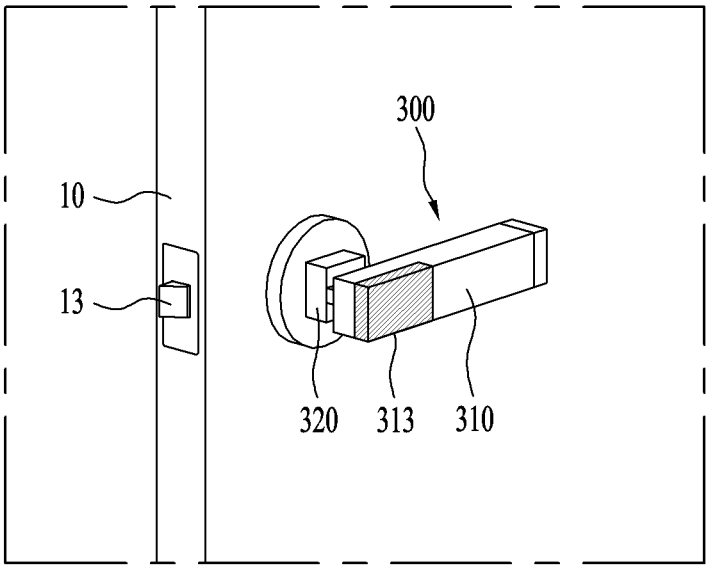
FIG. 14 is a perspective view illustrating a safety door lock using a door handle in accordance with yet another embodiment of the present invention.
Figure 15:
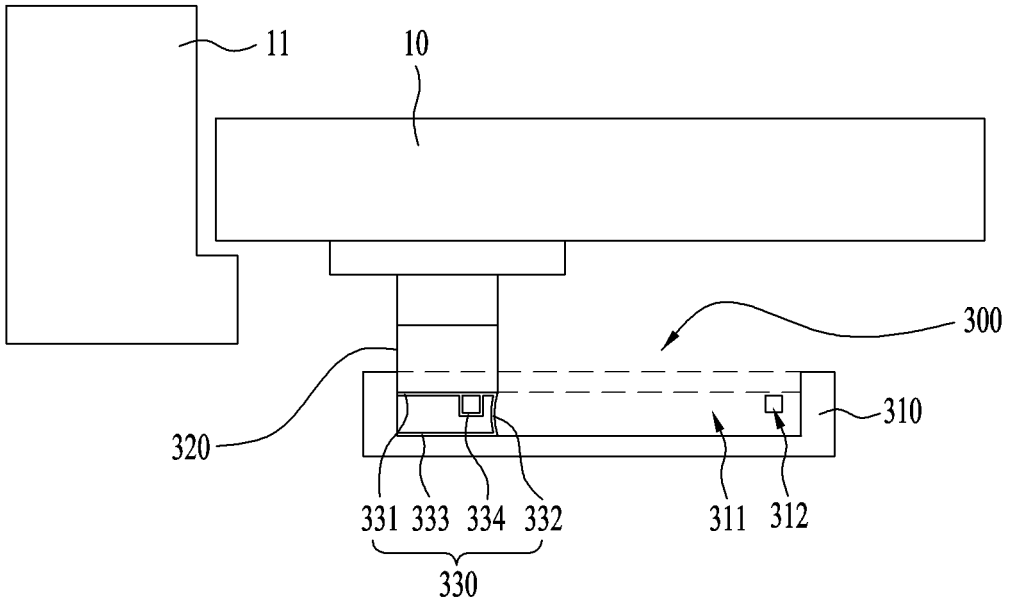
FIG. 15 is a cross-sectional view illustrating the safety door lock shown in FIG. 14.
Figure 16:
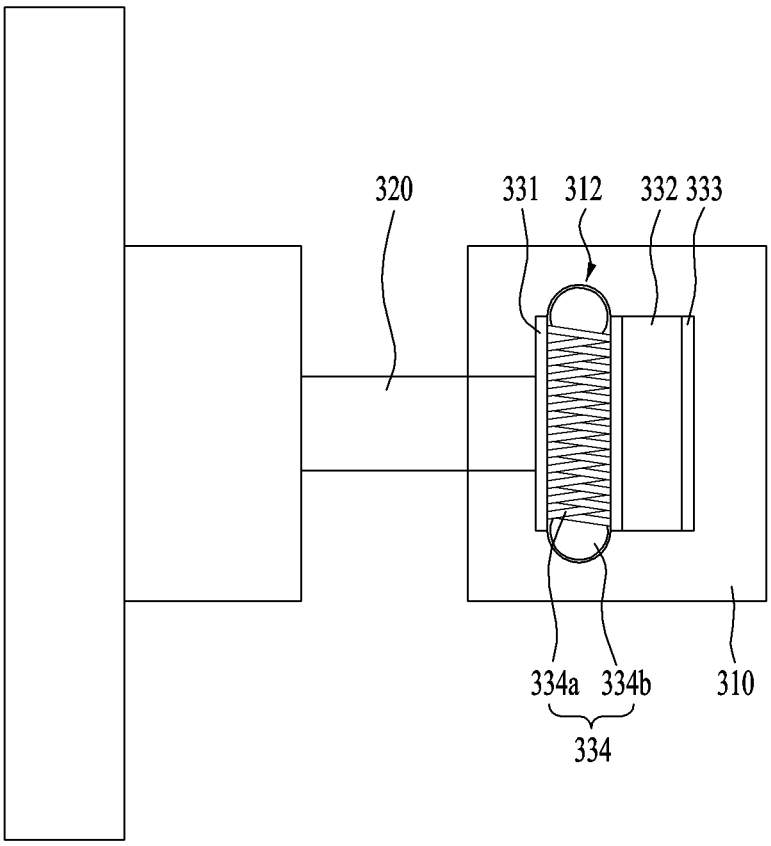
FIG. 16 is a cross-sectional view illustrating the side surface of the safety door lock shown in FIG. 14.

FIG. 14 is a perspective view illustrating a safety door lock 300 using a door handle in accordance with yet another embodiment of the present invention, FIG. 15 is a cross-sectional view illustrating the safety door lock 300 shown in FIG. 14, and FIG. 16 is a cross-sectional view illustrating the side surface of the safety door lock 300 shown in FIG. 14.

With reference to FIGS. 14 to 16, the safety door lock 300 in accordance with another embodiment of the present invention includes a door handle 310 configured to be rotatable in the vertical direction and to slidably reciprocate in the horizontal direction and having a sliding groove 311 on the side surface thereof adjacent to a door, a body 320 combined with the inside of the sliding groove 311 to form a rotating shaft with another door handle provided at the other side of the door and supporting sliding of the door handle 310 so as to protrude the door handle 310 from the front end of the door, and an elastic unit 330 fixed to the body 320, relatively sliding within the sliding groove 311 and elastically relaxing the door handle 310 and the body 320.

Differently from the above-described former embodiments, the safety door lock 300 in accordance with this embodiment of the present invention has a structure in which the door handle 310 reciprocates in the sliding manner.

Although FIG. 14 illustrates the door handle 310 as having a square pillar shape, the shape of the door handle 310 is not limited thereto. Of course, the door handle 310 may have a cylindrical shape or a shape having an oval cross-section.

As exemplarily shown in FIG. 15, the sliding groove 311 is formed within the door handle 310 in the length direction. The sliding groove 311 is formed on the side surface of the door handle 310 adjacent to the door 10. The elastic unit 330 is disposed at the end of the body 320, and the elastic unit 330 and a part of the body 320 are inserted into the sliding groove 311 and support rotation or linear reciprocation of the door handle 310.

Further, position fixing grooves 312 formed on the surface of the sliding groove 311 are formed at both sides of the door handle 31. By inserting a part of the elastic unit 330 into the position fixing groove 312, the position fixing groove 312 provides a function of fixing the position of the door handle 310 on the body 320.

The elastic unit 330 includes a fixing member 331 fixed to the body 320, an elastic member 332 bent integrally from one end of the fixing member 331, a support member 333 extending integrally from the elastic member 332 and disposed in parallel with the fixing member 331 so as to be elastic relative to the fixing member 331, and a fixing unit 334 (with reference to FIG. 16) provided on the fixing member 331 or the elastic member 332 to fix the door handle 310 sliding on the elastic unit 330 to a designated position.

A structure formed by the fixing member 331, the elastic member 332 and the support member 333 has an approximately 'C' shape and thus one side of the elastic unit 330 serves as a free terminal. Therefore, the support member 333 is elastically rotated relative to the fixing member 331 about the elastic member 332.

Therefore, the door handle 310 may be provided to be elastically rotated on the body 320.

As exemplarily shown in FIG. 16, the fixing unit 334 is provided within the elastic unit 330. The fixing unit 334 includes an elastic spring 334*a* provided within a guide hole (not shown) formed within the elastic unit 330 and a pair of bearings 334*b* disposed at both ends of the elastic spring 334*a* and configured to interfere with the door handle 310.

Therefore, when the bearings 334*b* are disposed in the position fixing groove 312 located at one side of the door handle 310, the door opening and closing mode may be executed and, when the beatings 334*b* are disposed in the position fixing groove 312 located at the other side of the door handle 310, the door closing prevention mode may be executed.

The elastic spring 334*a* is configured to press the bearings 334*b* disposed at both sides thereof in both directions and, thus, if the door handle 310 is located at a position corresponding to the position fixing grove 312 during sliding, presses the bearings 334*b* so as to be inserted into the position fixing groove 312.

Figure 17A:
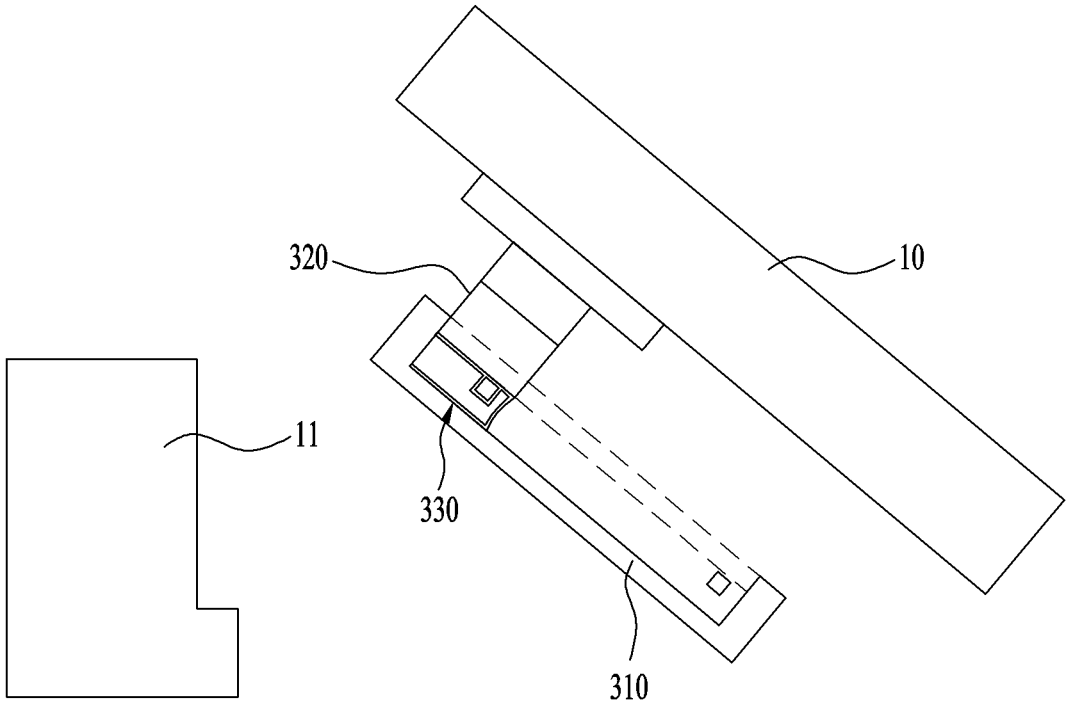
FIGS. 17A to 17C are reference views illustrating operation of the safety door lock shown in FIG. 15.
Figure 17B:
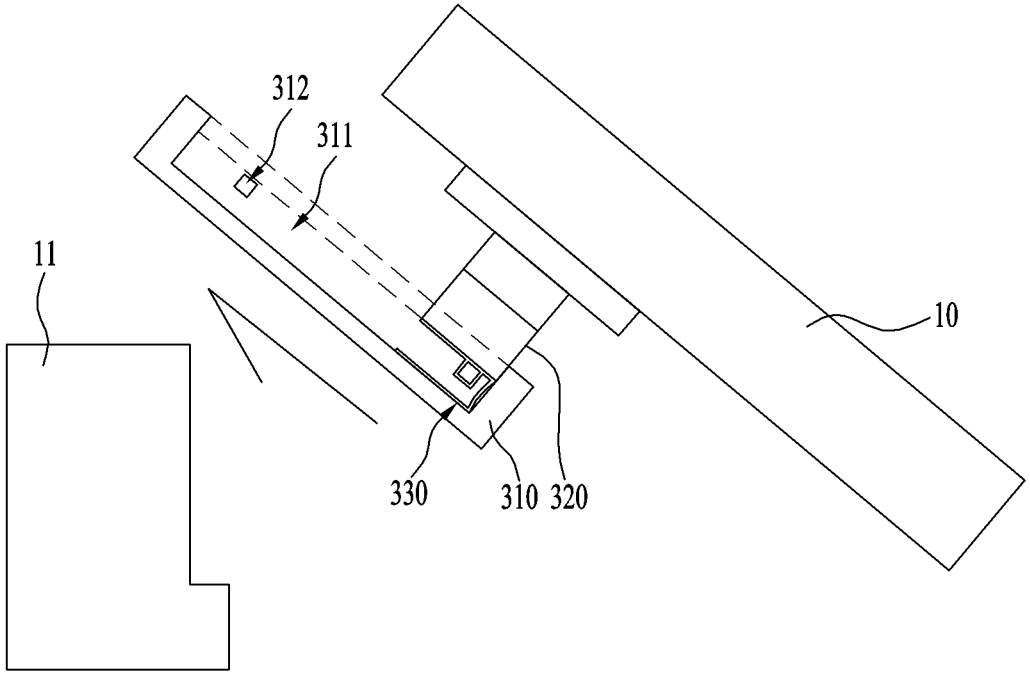
Figure 17C:
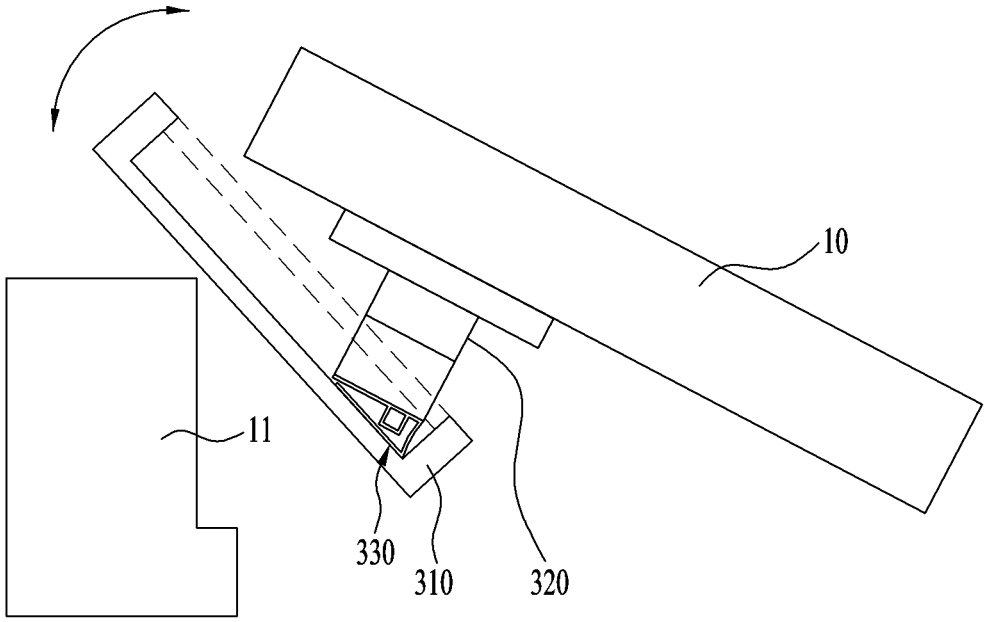
Figure 18:
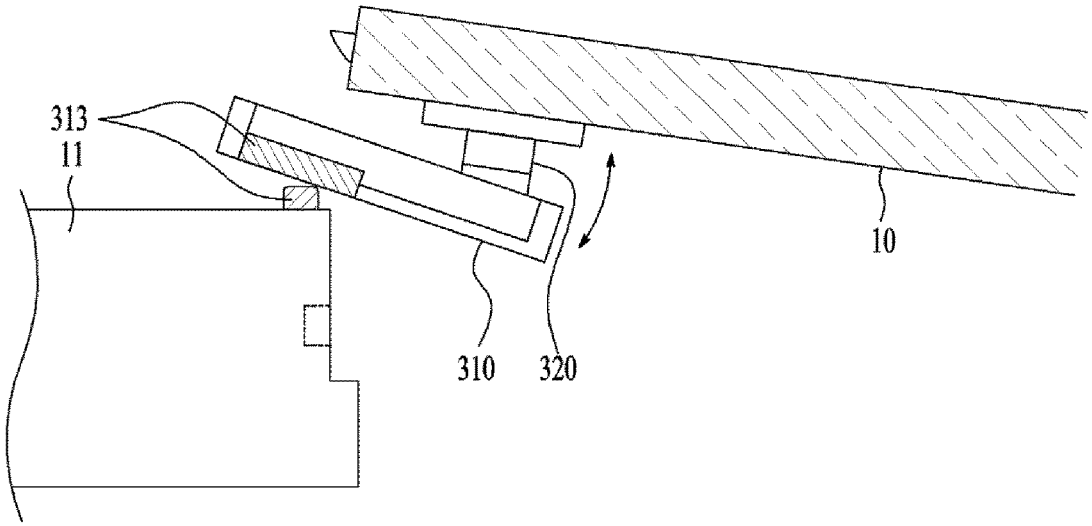
FIGS. 18 and 19 are reference views illustrating the safety door lock shown in FIG. 15 in a state in which external force is applied thereto.
Figure 19:
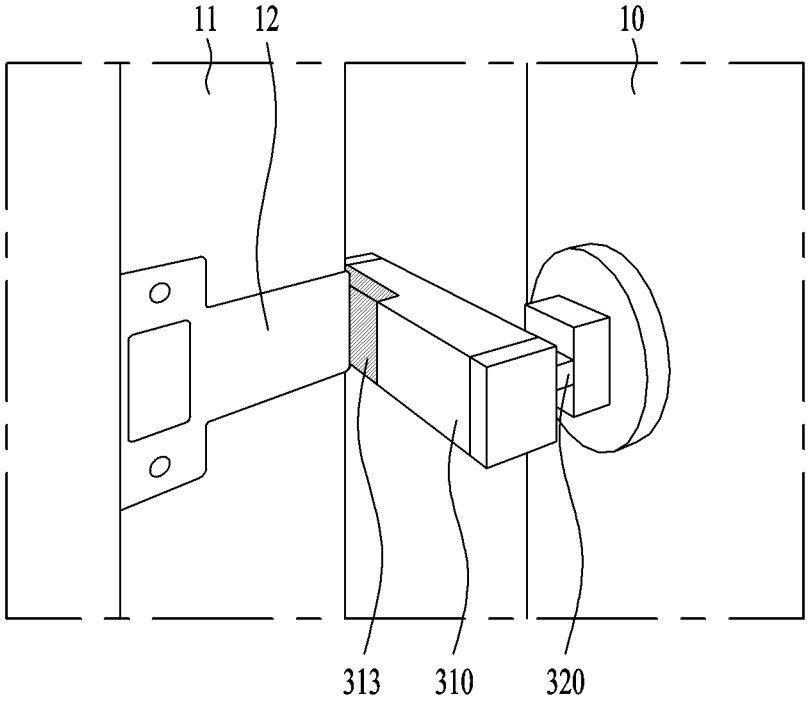

FIGS. 17A to 17C are reference views illustrating operation of the safety door lock 300 shown in FIG. 15 and FIGS. 18 and 19 are reference views illustrating the safety door lock 300 shown in FIG. 15 in a state in which external force is applied thereto.

The door handle 310 executes the same function as a handle provided at a general door 10, when the state of FIG. 15 is shifted to the state of FIG. 17A. Here, the door handle 310 is grasped by a user and thus executes a function of opening and closing the door, or the door handle 310 grasped by the user is rotated and thus executes a function of opening and closing the door.

Further, as exemplarily shown in FIG. 17B, when the door handle 310 is pressed in the horizontal direction, the door handle 310 protrudes outwards from the front end of the door 10. Simultaneously, the elastic unit 330 is separated from the positing fixing groove 312 formed at one side of the door handle 310 and is fixed to the position fixing groove 312 formed at the other side of the door handle 310 and, thus, the door handle 310 slide on the body 320 to be transferred.

Then, if external force is applied to the door 10 to close the door 10, as exemplarily shown in FIG. 17C, the door handle 310 interferes with the doorpost 11 or the strike plate 12 (with reference to FIG. 19) and prevents closing of the door 10. Simultaneously, as the shape of the elastic unit 330 is deformed by the external force, transmission of impact to the door handle 310 or the door 10 may be prevented. Thereby, safety accidents due to sudden closing of the door may be prevented.

As exemplarily shown in FIG. 18, a protective member 313 to prevent abrasion or noise generated by contact is provided on at least one of the door handle 310 and the doorpost 11 or the strike plate 12 adjacent to the edge of the front end of the door 10. The protective member 313 may be provided on both of the door handle 310 and the doorpost 11 or the strike plate 12 so as to prevent abrasion or noise.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

SEQUENCE LIST TEXT

100, 200, 300: safety door lock using door handle
110, 210, 310: door handle 120, 220, 320: body
130, 330: elastic unit 230: extension part
240: handle setting unit
10: door 11: doorpost

The invention claimed is:

1. A door handle assembly configured to prevent accidental closing of a door, comprising:

a door handle configured to be rotatable about a rotational axis and to slidably reciprocate in a horizontal direction, and having a sliding groove on the side surface thereof adjacent to the door;

a body combined with an inside of the sliding groove to form a rotating shaft with another door handle provided at the other side of the door and supporting sliding of the door handle so as to protrude the door handle from a front end of the door; and an elastic unit fixed to the body, elastically relaxing the door handle and the body, wherein the elastic unit includes:

a fixing member fixed to the body, an elastic member bent integrally from one end of the fixing member, a support member extending integrally from the elastic member and disposed in parallel with the fixing member so as to have elasticity relative to the fixing member, and a fixing unit provided within the elastic unit to fix the door handle sliding on the elastic unit to a designated safety position in a moving path of the door, interference with the closing of the door.

2. The door handle assembly configured to prevent accidental closing of the door according to claim 1, wherein the fixing unit includes:

an elastic spring provided within a guide hole formed within the elastic unit; and a pair of bearings disposed at both ends of the elastic spring and configured to interfere with the door handle.

3. The door handle assembly configured to prevent accidental closing of the door according to claim 2, wherein the door handle includes position fixing grooves formed within the sliding groove so as to correspond to the position of the fixing unit, the pair of bearings being elastically inserted into the position fixing grooves.

4. The door handle assembly configured to prevent accidental closing of the door according to claim 1, further comprising a protective member provided on at least one of the door handle and a doorpost or a strike plate adjacent to the edge of the front end of the door to prevent abrasion or noise generated by contact.

5. A door handle assembly configured to prevent accidental closing of a door, comprising:

a door handle configured to be rotatable about a rotational axis between a first position and a second position in a moving path of the door, interference with the closing of the door, the door handle is provided adjacent to a front end of the door at one side of the door;

a body configured to form a rotating shaft with another door handle provided at the other side of the door or to support the door handle so as to be rotatable;

an elastic unit interposed between the body and the door handle and providing restoring force to elastically reciprocate the door handle on the body in the direction of the rotating shaft; and a shock absorption unit provided at a bent part of the door handle so as to elastically rotate the door handle in a horizontal direction, wherein the door handle includes a first handle part to be grasped by a user and a second handle part elastically connected to one side of the first handle part about the rotational axis, and the shock absorption unit is provided at a connection region between the first handle part and the second handle part and elastically coupling the first handle part with the second handle part, wherein the shock absorption unit includes:

a coupling hole formed at one side of the first handle part;

a connection shaft coupled with an inside of the coupling hole and serving to couple the first handle part with the second handle part so as to be rotatable with respect to the second handle part;

a torsion spring coupled with the connection shaft and providing elastic force to the first handle part and the second handle part;

a noise proof member provided at a part of the inner surface of the coupling hole contacting the second handle part during rotation of the first handle part; and a shock absorption member provided at a part of the second handle part contacting the first handle part in a state in which the first handle part and the second handle part are provided at a right angle.

6. The door handle assembly configured to prevent accidental closing of the door according to claim 5, wherein the body includes:

an interference member detachably coupled with the door handle and selectively interworking with rotation of the door handle; and a mount member configured to fix the interference member to the door so as to be rotatable.

7. The door handle assembly configured to prevent accidental closing of the door according to claim 6, wherein a coupling groove is formed within one of the interference member and the door handle, the other one of the interference member and the door handle corresponds to the shape of the coupling groove and is detachably inserted into the coupling groove, and the coupling groove has an oval or polygonal cross-section.

8. The door handle assembly configured to prevent accidental closing of the door according to claim 6, wherein, if the door maintains the opened state, the door handle is separated from the interference member in the horizontal direction and then rotated about the rotational axis so as to protrude outwards from the edge of the front end of the door, and thus interferes with a doorpost or a strike plate adjacent to the edge of the front end of the door.

9. The door handle assembly configured to prevent accidental closing of the door according to claim 8, further comprising a protective member provided on at least one of the door handle and the doorpost or the strike plate adjacent to the edge of the front end of the door to prevent abrasion or noise generated by contact.

10. The door handle assembly configured to prevent accidental closing of the door according to claim 5, wherein the shock absorption unit includes:

a noise proof member provided at a part of the inner surface of the coupling hole contacting the second handle part during rotation of the first handle part; and a shock absorption member provided at a part of the second handle part contacting the first handle part in a right angle state between the first handle part and the second handle part.

11. A door handle assembly configured to prevent accidental closing of a door, comprising:

a door handle configured to be rotatable about a rotational axis between a first position and a second position in a moving path of the door, interference with the closing of the door, the door handle is provided adjacent to a front end of the door at one side of door;

a body configured to form a rotating shaft with another door handle provided at the other side of the door or to support the door handle so as to be rotatable;

an extension part combined with the body to separate the door handle from the door by a designated interval; and a handle setting unit configured to selectively rotate the door handle hinged to the extension part into one of a door opening and closing mode and a door closing prevention mode, wherein the handle setting unit includes:

another rotating shaft to couple second coupling pieces provided at one end of the door handle with a first coupling piece protruding from an end of the extension part so as to be rotatable;

elastic assemblies provided in inner spaces of the second coupling pieces and providing elastic force to interfere with rotation of the door handle on the first coupling piece about the another rotating shaft; and an extension piece extending to protrude one end of the second coupling pieces from an extension line of a radius of rotation formed around the another rotating shaft, wherein fixing grooves concaved from the inner surface of one side of the first coupling piece are formed at positions contacting the second coupling pieces, wherein a fixing protrusion protruding at a position corresponding to the positions of the fixing grooves and inserted into the fixing grooves to prevent separation of the second coupling pieces from the first coupling piece is formed on the second coupling pieces.

12. The door handle assembly configured to prevent accidental closing of the door according to claim 11, wherein each of the elastic assemblies includes:

a spring provided within the inner space; and a bush member interposed between the spring and the another rotating shaft to press the another rotating shaft using elastic force of the spring.

13. The door handle assembly configured to prevent accidental closing of the door according to claim 11, further comprising a protective member provided on at least one of the door handle and a doorpost or a strike plate adjacent to the edge of the front end of the door to prevent abrasion or noise generated by contact.

* * * * *